US010851731B2

(12) United States Patent
Musumeci et al.

(10) Patent No.: US 10,851,731 B2
(45) Date of Patent: Dec. 1, 2020

(54) METHOD FOR CONTROLLING A DELIVERY OF DRIVING TORQUE OF A COMBUSTION ENGINE OF AN AGRICULTURAL TRACTOR

(71) Applicant: FPT INDUSTRIAL S.P.A., Turin (IT)

(72) Inventors: Salvatore Musumeci, Turin (IT); Simon Porter, Baldissero Torinese (IT)

(73) Assignee: FPT INDUSTRIAL S.P.A., Turin (IT)

( * ) Notice: Subject to any disclaimer, the term of this patent is extended or adjusted under 35 U.S.C. 154(b) by 6 days.

(21) Appl. No.: 15/772,745

(22) PCT Filed: Nov. 11, 2016

(86) PCT No.: PCT/IB2016/056813
§ 371 (c)(1),
(2) Date: May 1, 2018

(87) PCT Pub. No.: WO2017/081657
PCT Pub. Date: May 18, 2017

(65) Prior Publication Data

US 2019/0211771 A1 Jul. 11, 2019

(30) Foreign Application Priority Data

Nov. 11, 2015 (IT) ..... 102015000071580

(51) Int. Cl.
*F02D 41/24* (2006.01)
*F02D 31/00* (2006.01)

(52) U.S. Cl.
CPC ..... *F02D 41/24* (2013.01); *F02D 31/007* (2013.01); *F02D 41/2422* (2013.01); *F02D 2200/101* (2013.01); *F02D 2250/18* (2013.01)

(58) Field of Classification Search
CPC ..... F02D 41/24; F02D 31/007; F02D 31/001; F02D 31/00; F02D 2200/101; F02D 29/04
See application file for complete search history.

(56) References Cited

U.S. PATENT DOCUMENTS 6,202,629 B1 * 3/2001 Zhu ..... F02D 31/007 123/339.21
7,706,953 B1 * 4/2010 Sun ..... B60K 31/042 123/399

(Continued)

FOREIGN PATENT DOCUMENTS

DE 102008036378 2/2010
DE 102008036378 A1 * 2/2010 ..... A01D 41/1274

(Continued)

OTHER PUBLICATIONS

Patent Cooperation Treaty, International Search Report and Written Opinion for International Application No. PCT/IB2016/056813, dated Apr. 3, 2017, 12 pages.

(Continued)

*Primary Examiner* — George C Jin
(74) *Attorney, Agent, or Firm* — Stetina Brunda Garred and Brucker

(57) ABSTRACT

A method for controlling a delivery of driving torque of an engine of an agricultural tractor comprising a first step of monitoring a speed of said engine, and when said speed is stable, comprising a second step of maintaining it subsequently stable by compensating a load variation applied to the engine. The invention also concerns a fuel injection system implementing the above method.

10 Claims, 3 Drawing Sheets

(56) References Cited

U.S. PATENT DOCUMENTS

| | | | | |
|---|---|---|---|---|
| 2004/0123837 | A1* | 7/2004 | Rado | F02D 11/105 123/350 |
| 2013/0325292 | A1* | 12/2013 | Park | B60W 30/14 701/102 |
| 2014/0054902 | A1* | 2/2014 | Kawaguchi | F02D 41/021 290/40 B |
| 2017/0101948 | A1* | 4/2017 | Kunkel | F02D 41/0085 |
| 2018/0209357 | A1* | 7/2018 | Byttebier | B60W 30/188 |

FOREIGN PATENT DOCUMENTS

| | | | |
|---|---|---|---|
| EP | 2122357 | A2 | 10/2009 |
| WO | WO2011/031191 | | 3/2011 |

OTHER PUBLICATIONS

European Patent Office, Office Action of corresponding European Patent Application No. 16823318.7, dated May 26, 2020, 4 pages.

* cited by examiner

METHOD FOR CONTROLLING A DELIVERY OF DRIVING TORQUE OF A COMBUSTION ENGINE OF AN AGRICULTURAL TRACTOR

CROSS-REFERENCE TO RELATED APPLICATIONS

The present application claims priority to PCT International Application No. PCT/IB2016/056813 filed on Nov. 11, 2016, which application claims priority to Italian Patent Application No. 102015000071580 filed Nov. 11, 2015, the entirety of the disclosures of which are expressly incorporated herein by reference.

STATEMENT RE: FEDERALLY SPONSORED RESEARCH/DEVELOPMENT

Not Applicable

SCOPE OF THE INVENTION

The present invention relates to the field of methods of engine control and, precisely, methods of controlling the torque delivered.

STATE OF THE ART

Under certain operating conditions, agricultural tractors deliver torques comprised between 90-100% of the maximum torque that the engine can deliver at the given rotational speed with ploughs or other similar devices, which define the vast majority of the resistance torque applied to the vehicle.

This resistance torque is anything but constant, being dependent on the random size and compactness of the soil clods.

Therefore, when a resistive load peak occasionally occurs, the engine tends to slow down, thus lengthening the processing time, since the driver cannot do anything other than further accelerating up to the maximum power position.

SUMMARY OF THE INVENTION

The object of the present invention is to improve the behavioural stability of the engine of an agricultural tractor.

The main idea of the present invention is to monitor the engine speed, in terms of the number of revolutions of the same, to detect a stabilisation condition of the same and to vary the torque delivered both in a positive and negative way, so as to maintain said engine speed substantially constant, i.e. stable.

Preferably, the effects of the method are particularly detectable when, for any predefined rotational speed of the engine, the latter delivers a power of at least 90% of the maximum power that the engine can deliver at that predefined rotational speed.

Preferably, the torque/power delivered is varied by varying the map of the fuel, generally diesel, injection. In particular, the limitation curve of the fuel flow is varied, for example, for each injection cycle.

Another object of the present invention is an internal combustion engine adapted for installation in agricultural tractors, which implements the aforementioned control method.

A further object of the present invention is an agricultural tractor comprising the aforesaid internal combustion engine.

The claims describe preferred variants of the invention, thus forming an integral part of the present specification.

BRIEF DESCRIPTION OF THE FIGURES

Further objects and advantages of the present invention will be apparent from the following detailed description of an exemplary embodiment thereof (and variants thereof) and from the accompanying drawings given purely by way of non-limiting example, wherein:

FIG. 2 shows a first limit case of the torque curve, while

The same reference numbers and letters in the figures identify the same elements or components.

In the context of the present description the term "second" component does not imply the presence of a "first" component. These terms are in fact used for clarity only and are not intended as limiting.

DETAILED DESCRIPTION OF THE EXEMPLARY EMBODIMENTS

The method according to the present invention provides for monitoring continuously (Step 1) the speed of the internal combustion engine of an agricultural tractor. When the speed is stable (Step 2=Yes), then (Step 3) a compensating (feedback) control of the driving torque delivered by the engine is carried out such as to maintain a stable engine speed regardless of the variations in the resistance torque applied to the movement of the vehicle.

The execution of Step 3, i.e. the compensating control of the driving torque, is not activated by the driver, but performed automatically when the control of the Step 2 gives a positive outcome (YES).

Therefore, Step 3 is performed without the intervention of the driver.

Moreover, the stabilisation of the speed is performed regardless of the engine speed. In fact, Step 2 does not require that the speed be in a predefined range, but it should be stable around any one value of the engine speed.

Such resistance torque, as explained above, depends on external factors such as, for example, the compactness of the soil clods which are intended to be broken by ploughs or other appliances drawn and/or operated by the agricultural tractor.

Preferably, the method continues to compensate for the variations in the resistance torque applied to the engine as long as the driver does not change the position of the accelerator pedal (Step 4=Yes). If the driver acts on the accelerator pedal, then the method starts from the beginning.

Figure 1:
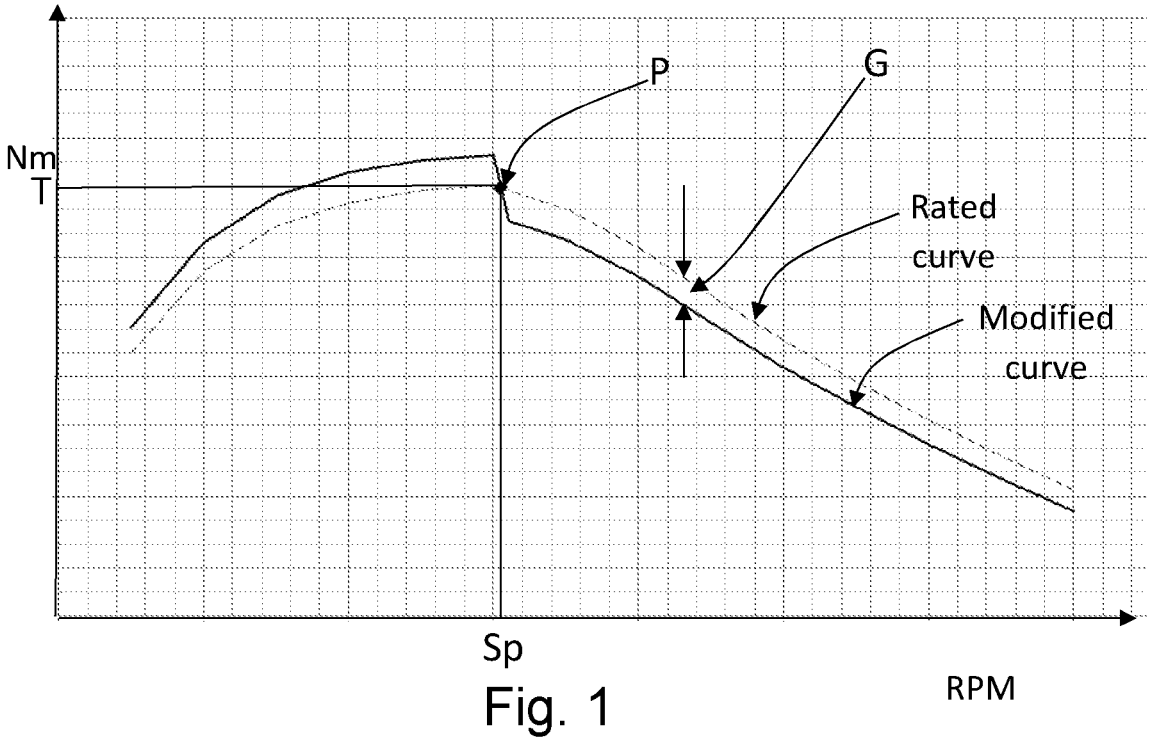
FIG. 1 shows a rated torque curve of an internal combustion engine, which is superimposed by a modified torque curve according to the control object of the present invention.
Figure 2:
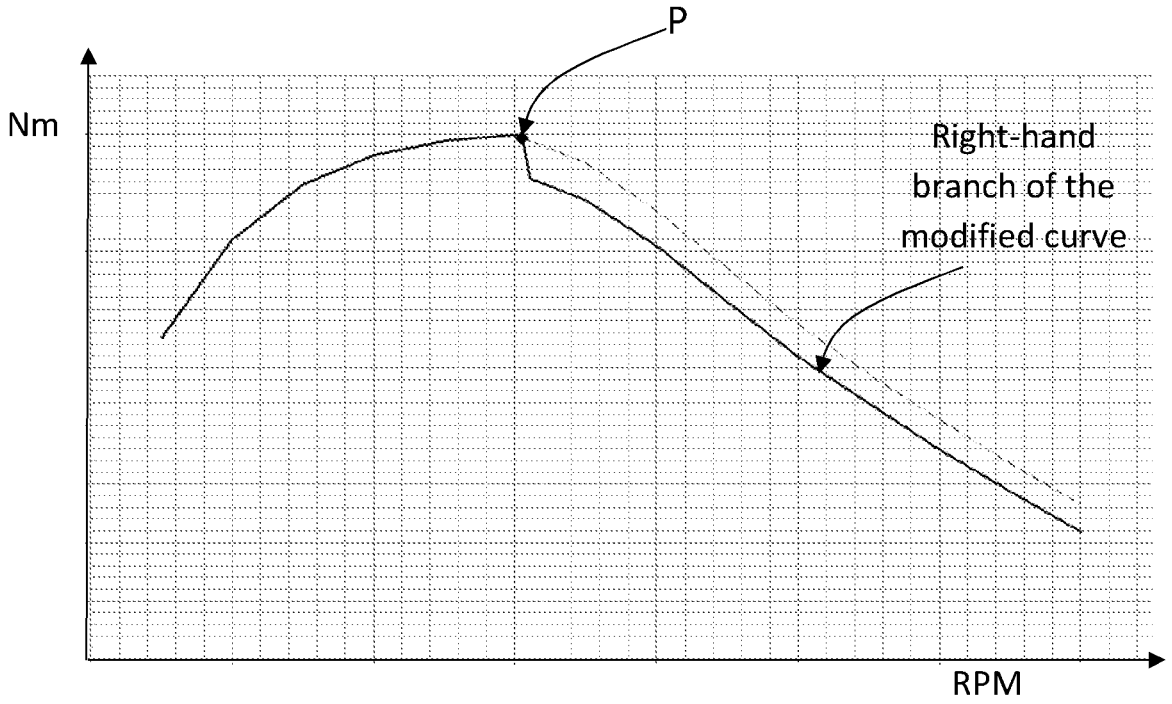
Figure 3:
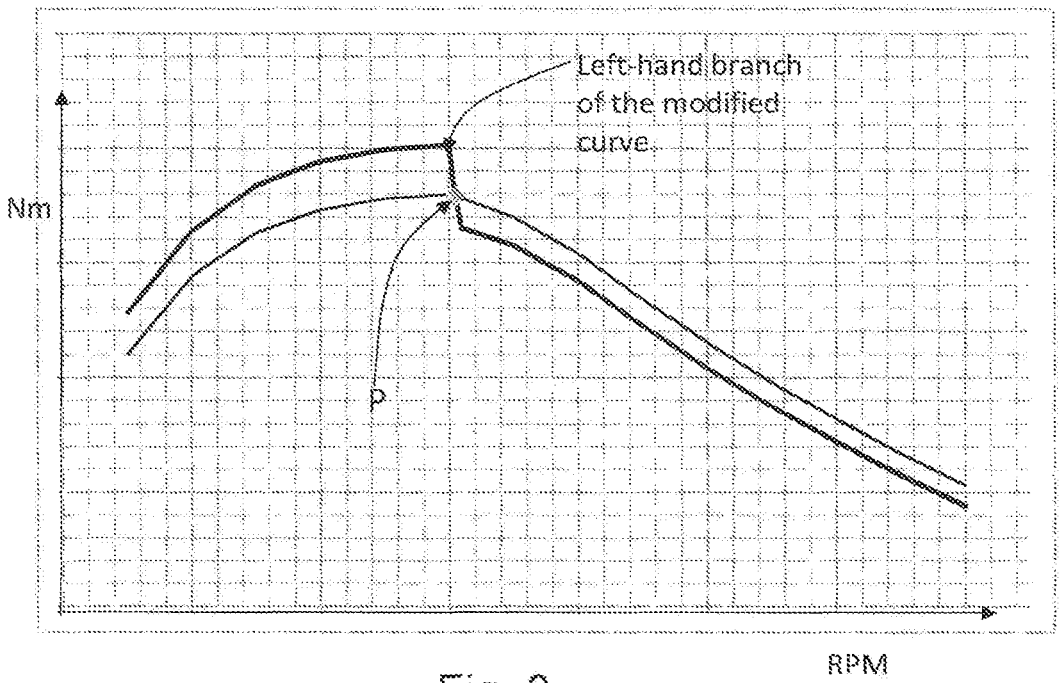
FIG. 3 shows a limit case, opposite to that of FIG. 2, of the torque curve modified by the control object of the present invention.

The engine speed is considered to be stable when it does not vary or it varies within a predefined range of revolutions, for example +/−5 rpm, in a time interval having an amplitude of seconds, for example comprised between 0.5 and 20 seconds. Preferably, the instantaneous speed is subtracted from the average speed of the engine, obtained by moving average, and when this difference in absolute value is lower than a predefined threshold, the stable engine speed, referred to as Sp in FIGS. 1-3, is considered.

When the torque control is active (Step 3), i.e. when the engine speed is stabilised according to the strategy which is the object of the present invention, the torque delivered by the engine is increased by a constant value (gap/distance) for negative speed values (rpm) with respect to the stability value Sp identified above and/or decreased by a constant value (gap/distance) for positive speed values with respect to such stability value. Therefore, the rated torque curve is modified as shown in FIG. 1, wherein the dotted line represents the rated torque curve, while the continuous curve represents its modification caused by the control object of the present invention.

In the neighbourhood of the stability point P (Sp, T), the modified torque curve comprises a preferably rectilinear, connecting segment, with a negative slope passing through the stability point P and having two portions substantially symmetrical with respect to this point. In addition, the modified torque curve comprises a left-hand branch shifted upwards for lower speeds (left) with respect to the stable speed Sp, and a right-hand branch shifted downwards for higher speeds (right) with respect to the stable speed Sp.

According to a preferred variant of the invention, the connecting segment between the two portions, the right one and the left one, is rectilinear, according to another variant it is exponential, etc.

The width of the connection can be varied according to the reactivity of the control to be obtained.

Preferably, such raising/lowering is of the order of a few percentage points 1-10%. Therefore, the absolute change between the right-hand branch and the left-hand branch of the curve is of the order of 2-20%.

This width, as will be apparent hereinafter, can be fixed or variable with limit thresholds, a function of additional engine parameters and/or of an energy stored/accumulated by means of the present strategy.

Preferably, the present method, in addition to carrying out a compensating control, which in fact is instantaneous, also performs a medium-long term control which tends to maintain the average power delivered by the engine similar to the power delivered by the same without the present invention, regardless of external and unpredictable causes that may intervene.

The controlling of the average power is preferably accomplished with a logic that simulates a virtual flywheel.

When the motor point, due to lower resistance, moves to the right with respect to the stability point of FIGS. 1-3, it follows the right-hand branch of the modified curve, with a saving of energy, vice versa, when the motor point, due to higher resistance, moves to the left with respect to the stability point of FIGS. 1-3, it follows the left-hand branch of the modified curve, with consumption of the energy saved previously.

When the difference in revolutions is positive, the engine provides less torque than the rated torque and, therefore, according to the present invention, the modified torque curve is lowered/decreased and consequently energy—i.e. fuel—is spared and saved as kinetic energy of said virtual flywheel. When, on the contrary, the difference in revolutions is negative, then the load applied to the engine is higher than the rated torque, and in this case the energy previously spared is consumed by the engine in order to counteract one or more occasional increases in load, by raising/increasing the torque curve. Therefore, the engine consumes "extra" energy exceeding that allowed by the rated torque curve thanks to the raising of the left-hand branch of the torque curve.

According to a preferred variant of the invention, an estimator calculates in time the increase or decrease rate of the energy accumulated in the virtual flywheel, by correcting the above-mentioned torque curve.

For example, if the accumulated energy is greater than a first threshold, the control system increases the gap between the rated curve and the left-hand branch of the modified curve, see FIG. 3. If necessary, the control system changes, additionally or alternatively, the right-hand branch of the modified torque curve, in particular, the control system reduces the gap between the rated curve and the right-hand branch of the modified curve. Vice versa, when the accumulated energy is zero or close to zero, then the control system increases the gap/distance between the right-hand branch of the modified curve and the rated curve and/or decreases the gap between the rated curve and the left-hand branch of the modified curve, see FIG. 2.

From a comparison between FIGS. 2 and 3, it is clear that the control system can adjust the gap of one or both branches of the modified curve so as to obtain a predefined objective value of energy stored in the virtual flywheel.

In this way, the average power of the engine remains unchanged.

Moreover, the limit gap G between the left-hand branch and the rated curve can be varied as a function of operating parameters of the engine, such as for example the temperature of the engine or of other mechanical parts that are more stressed by the increase in torque due to the compensation effect implemented by the present method. Therefore, for example, when the engine is cold, the left gap can be limited to +/−1% to then arrive at a maximum of +/−5%. But if the temperature rises excessively, it could be reduced to +2%.

Since it is not possible to know a priori how the average statistical value of the resistances applied to the engine varies in time, the engine could be required to deliver more or less of its rated torque for a long period.

Figure 4:
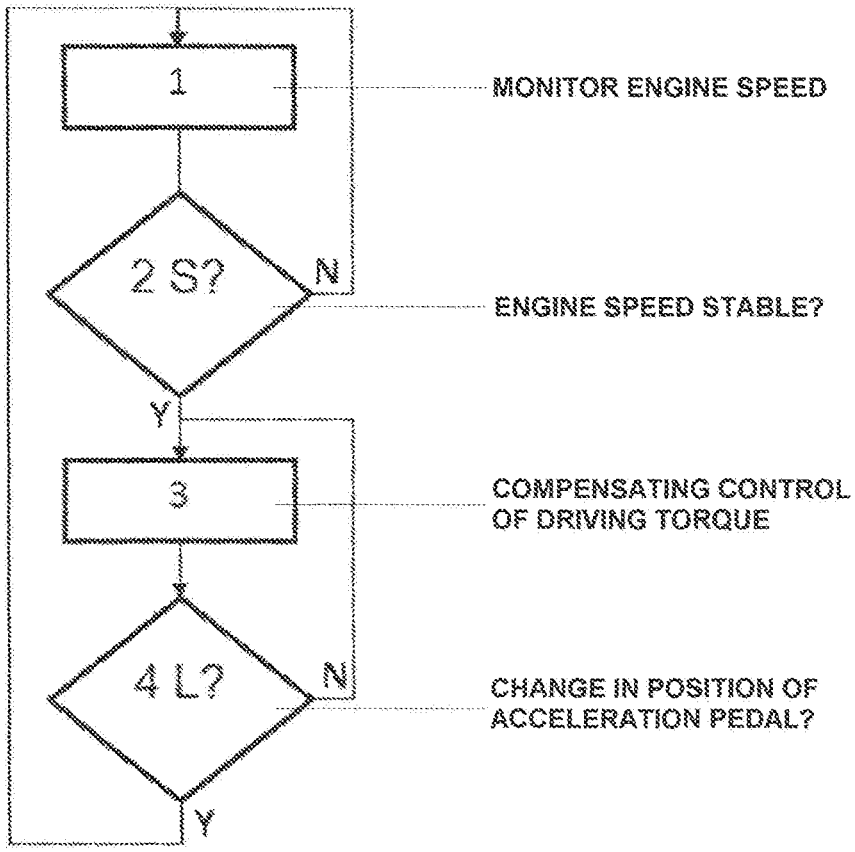
FIG. 4 shows a flow diagram representing a preferred implementation of the control method object of the present invention.
Figure 5:
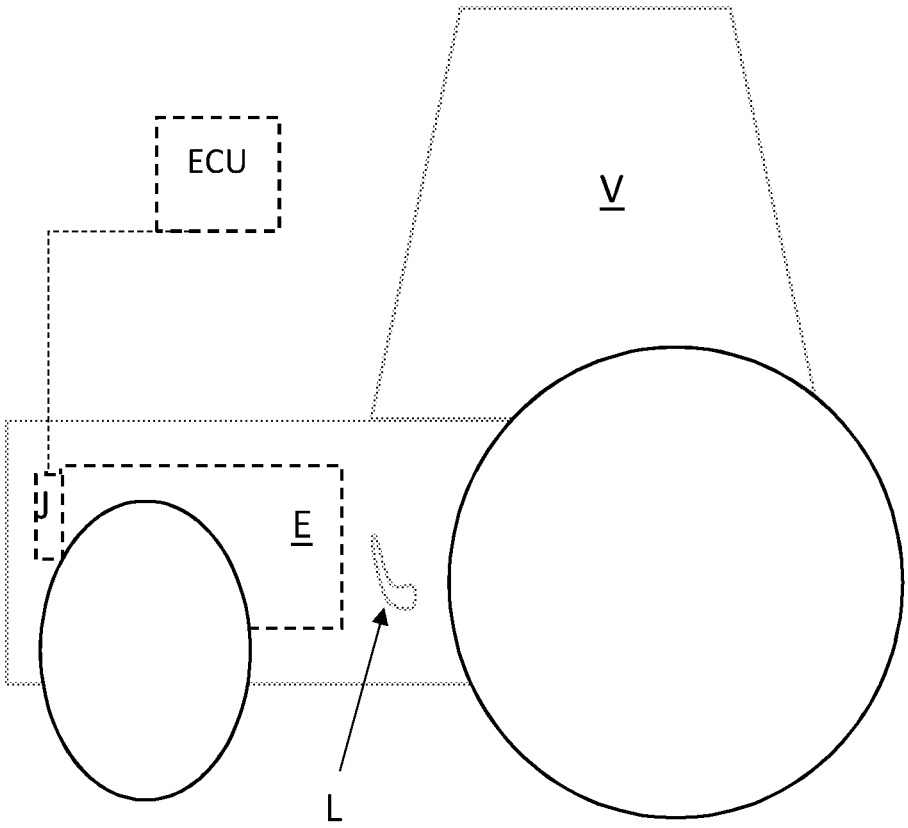
FIG. 5 shows an agricultural vehicle comprising an internal combustion engine and ECU processing means for controlling the injection means J of the fuel of the internal combustion engine E, for implementing the method object of the present invention.

If after stabilization of the engine speed the resistance torque applied thereto reaches a permanently higher value, the engine is required to deliver a torque greater than the rated torque until the energy accumulated in said virtual flywheel runs out, subsequently, the operating point P moves to a lower speed value, a new stability point P is identified, to which the above compensation control of step 3 in FIG. 4 is applied.

In contrast, when the ground becomes less compact, the control system, even though it raises the left-hand branch of the modified curve up to a maximum gap/distance allowed by the rated curve, fails to consume the energy accumulated in the virtual flywheel, which on the contrary continues to rise indefinitely. Preferably, the present control system, after the left-hand branch of the modified torque curve is brought to the maximum gap G allowed, begins to progressively raise the right-hand branch, too, possibly until it coincides with the rated torque curve. This upward shift of the right-hand branch of the modified curve causes the engine to increase its speed, identifying a new stability point to which the step 3 of the present method is applied.

Therefore, an adjustment is carried out, in the medium-long term, also on the stabilization speed so as to avoid causing a reduction in the performance of the engine.

Preferably, this virtual flywheel is only capable of storing energy and then returning it so as not to vary the rated power of the engine. By contrast, the control system, as soon as it detects the reaching of an accumulated threshold energy, and even with an increase in the left gap, i.e. the distance between the left-hand branch of the modified/shifted torque curve and the rated one, then begins to decrease the right gap between the right-hand branch of the modified torque curve and the rated one, and this implies that the control system gradually increases the engine speed, i.e. it shifts the stability point P of the engine to the right in the graph until the accumulated energy takes on a stable value.

Therefore, the torque curve is preferably adjusted temporally and quantitatively in a continuous manner as a function of the difference in revolutions (−/+Δrpm) and also in the mean value of the resistance torque applied to the engine. This adjustment is subsequently saturated by a function that considers the amount of energy (fuel) stored in said virtual flywheel so as to ensure that the average power delivered during a work cycle does not undergo variations with respect to the adoption of the rated torque curve. In steady state conditions, the engine consumes no more and no less than the relative rated consumptions.

Advantageously, this preferred variant of the present invention avoids that an extra power is accumulated or delivered for too long, which, in fact, may modify the average power delivered.

The advantage is not only that the dynamic behaviour of the engine is stabilised against external disturbances, but also that the handling of the vehicle is improved, which appears more ready for use, as if it belonged to a higher performance class, while maintaining rated power and consumption substantially unchanged.

This strategy is preferably active only when the power requirement is very close to 100% of the power that the engine can deliver at a predefined speed.

Therefore, the present strategy can be inhibited as long as the power delivered by the engine is less than 90% of the rated power at the stability point P. It is noted that the effects of the present strategy are less evident towards lower power levels, hence, alternatively, the present strategy can be implemented continuously regardless of the value of the power actually delivered.

The present invention can be advantageously carried out by means of a computer program comprising coding means for performing one or more steps of the method, when this program is run on a computer. It is therefore understood that the scope of protection covers said computer program and also computer readable media that comprise a recorded message, said computer readable media comprising program coding means for performing one or more steps of the method, when said program is run on a computer.

The person skilled in the art is able to achieve the object of the invention from the aforesaid description without introducing further construction details. The elements and features disclosed in the various preferred embodiments, including the drawings, may be combined with one another without however departing from the scope of protection of the present application. What is described in the chapter on the state of the art is only for a better understanding of the invention and does not represent a statement of existence of what is described. Moreover, unless specifically excluded in the detailed description, what is described in the chapter on the state of the art can be considered in combination with the features of the present invention, thus forming an integral part of the present invention. None of the features of the different variants is essential, therefore, the individual features of each preferred variant or drawing may be individually combined with the other described embodiments.

The invention claimed is:

1. A method for controlling a delivery of driving torque of a combustion engine of an agricultural tractor comprising:

a first step (Step 1) of monitoring a speed of said engine;

a second step (Step 2) of determining whether said speed is stable around a stable speed value (Sp) of the engine by comparison of said speed or a value derived therefrom to a predefined threshold; and a third automatic step of maintaining it stable by compensating (Step 3) a load variation applied to the engine in response to a determination that said speed is stable in Step 2, said compensating comprising generating a modified torque curve starting from a rated torque curve shifting it upwards for only negative speed values—left-hand branch—with respect to said stable speed value (Sp) of the engine and/or shifting it downwards for only positive speed values—right-hand branch—with respect to said stable speed value (Sp) of the engine, said modified torque curve spaced from the rated torque curve by a distance (G), wherein, thereafter, as the engine speed moves above the stable speed value (Sp), the delivery of driving torque follows the right-hand branch of the modified torque curve, and as the engine speed moves below the stable speed value (Sp), the delivery of driving torque follows the left-hand branch of the modified torque curve.

2. The method according to claim 1, comprising a step of calculating an energy saved due to said downward shift of said right-hand branch of the rated torque curve and calculating an energy consumed due to said upward shift of said left-hand branch of the rated torque curve.

3. The method according to claim 2, further comprising a step of adjusting said distance (G) of said right-hand branch and if necessary of said left-hand branch with respect to said rated torque curve so as to reach an objective value of overall energy saved, namely net of said energy consumed.

4. The method according to claim 3, wherein when said value of positive energy saved exceeds a predefined threshold, and possibly continues to grow indefinitely, despite having raised/increased the distance of the left-hand branch of the modified curve with respect to the rated torque curve, then the method comprises a step of raising/reducing a distance of the right-hand branch of the modified curve with respect to the rated torque curve, determining an increase in the engine speed, determining a new stability speed.

5. The method according to claim 1, wherein said compensation step is implemented by varying a limitation curve of a flow rate of fuel injected into the engine cylinders.

6. The method according to claim 1, further comprising a step of interrupting said compensation step (Step 3) when a driver acts (Step 4=Yes) by varying a relative position of the accelerator pedal (L).

7. The method according to claim 1, wherein a limit distance (G) between said left-hand branch and said rated torque curve is a function of operating parameters of the engine, such as a temperature of the engine.

8. A control system (ECU) for controlling delivery of a drive torque of an engine (E) of an agricultural tractor (V) comprising fuel injection means (J) and processing means configured to control said injection means and to implement the control method according to claim 1.

9. An internal combustion engine of an agricultural tractor provided with a feed system according to claim 8.

10. An agricultural tractor comprising the internal combustion engine according to claim 9.

* * * * *